US006616588B2

(12) United States Patent
Takahashi et al.

(10) Patent No.: US 6,616,588 B2
(45) Date of Patent: Sep. 9, 2003

(54) CENTRIFUGAL SEPARATOR WITH ROTOR IDENTIFICATION

(75) Inventors: Hiroyuki Takahashi, Hitachinaka (JP); Kenichi Tetsu, Hitachinaka (JP); Toshiyuki Suzuki, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/150,921

(22) Filed: May 21, 2002

(65) Prior Publication Data

US 2002/0183184 A1 Dec. 5, 2002

(30) Foreign Application Priority Data

May 21, 2001 (JP) ..... 2001-150880

(51) Int. Cl.[7] ..... B04B 13/00
(52) U.S. Cl. ..... 494/10
(58) Field of Search ..... 494/1, 7–12, 16, 494/20, 84; 318/254; 340/671, 681, 870.34; 388/809, 811, 814, 907.5, 912

(56) References Cited

U.S. PATENT DOCUMENTS 3,582,699 A * 6/1971 Badessa et al.
3,832,614 A * 8/1974 Olliffe
4,551,715 A * 11/1985 Durbin
4,601,696 A * 7/1986 Kamm
4,700,117 A * 10/1987 Giebeler et al.
4,772,254 A * 9/1988 Grassl et al.
4,827,197 A * 5/1989 Giebeler
5,037,371 A * 8/1991 Romanauskas
5,221,250 A * 6/1993 Cheng
5,235,864 A * 8/1993 Rosselli et al.
5,338,283 A * 8/1994 Fleming et al.
5,342,280 A * 8/1994 Niinai et al.
5,382,218 A * 1/1995 Uchida
5,649,893 A * 7/1997 Inaniwa et al.
5,726,881 A * 3/1998 Inaniwa et al.
5,917,688 A * 6/1999 Kido et al.
2002/0042334 A1 * 4/2002 Tetsu et al.
2002/0147095 A1 * 10/2002 Akatsu et al.
2002/0160900 A1 * 10/2002 Akatsu et al.

FOREIGN PATENT DOCUMENTS

GB 2240496 * 8/1991
JP 3-34279 7/1991
JP 10-34021 * 2/1998
JP 2001-46917 2/2001

* cited by examiner

*Primary Examiner*—Charles E. Cooley
(74) *Attorney, Agent, or Firm*—McDermott, Will & Emery

(57) ABSTRACT

Each of the rotors has a plurality of identification marks arranged on a circumference defined by the rotation axis on a surface thereof with angular intervals which are determined for each of the different rotors. The identification marks are detected with an identification mark detector such as a magnet detector. The rotational speed of the rotation axis is detected. The angular intervals are detected to identify the attached rotor. The rotating speeds are measured from the pulses at first detection of one of the identification marks and second detection of the one of identification marks after one rotation of the rotation axis. The time intervals of the identification marks between the first and second detection are measured. The angular intervals are calculated by integrating the measured rotating speeds with the time intervals, respectively.

3 Claims, 2 Drawing Sheets

CENTRIFUGAL SEPARATOR WITH ROTOR IDENTIFICATION

BACKGROUND OF THE INVENTION

1. Field of the Invention

This invention relates to a centrifugal separator with a function for detecting information regarding the used rotor.

2. Description of the Prior Art

In a centrifugal separator having an attachment for attaching one of different (types of) replaceable rotors thereto, it is desirable to detect the type of the attached rotor. Japanese utility model No. 1941678 discloses a technique of detecting position angles of identification marks arranged on a circular circumference of the rotor to determine the used rotor. Another prior art centrifugal apparatus is described in Japanese patent application No. 2000-307012 (filed on Oct. 6, 2000) which was applied by the same assignee of this application (corresponding U.S. patent application Ser. No. 09/969,807), wherein the time intervals of the detected identification marks are measured while the rotational speed of the rotor is constant. The type of the attached rotor is judged from angular intervals of the identification marks obtained from the product of the measured time intervals and the rotational speed.

Because this measurement is done at a constant speed during the starting period of rotation, the acceleration interval becomes longer.

If this measurement would be done while the rotation of the rotor is being accelerated, the measurement error will occur. Therefore, it is required to accurately detect the angular intervals of the identification marks on the rotor during acceleration of the rotation of the rotor.

SUMMARY OF THE INVENTION

The aim of the present invention is to provide a superior centrifugal separator.

According to the present invention, a first aspect of the present invention provides a centrifugal separator comprising:

a rotating unit having a rotation axis;

a rotor attaching means for attaching one of different replaceable rotors to said rotation axis, each of said rotors having a plurality of identification marks arranged on a circumference defined by said rotation axis on a surface thereof with angular intervals which are predetermined for each of said different rotors;

identification mark detection means for detecting said identification marks in accordance with rotation of said attached rotor;

a rotation detector for detecting rotation of said rotation axis to generate a rotational speed signal; and detection means responsive to said identification mark detection means and said rotational speed signal for detecting said angular intervals to identify said attached rotor, wherein said detection means measures rotating speeds from said rotational speed signal at first detection of one of said identification marks and second detection of said one of identification marks after one rotation of said rotation axis from said first detection, measures time intervals of said detected identification marks from said first detection to said second detection, calculates calculation rotational speeds of said rotation axis when others of said identification marks are detected from said measured time intervals and from said rotational speeds at said first and second detections, and integrates said measured rotational speeds and said calculation rotational speeds with said measured time intervals to calculate said angular intervals, respectively, to identify said one of rotors attached to said rotating unit.

According to the present invention, a second aspect of the present invention provides the centrifugal separator based on the first aspect, wherein said rotation detector generates said rotational speed signal with a predetermined number of pulses being generated per said rotation with a first resolution which is lower than a second resolution in the calculated angular interval.

According to the present invention, a third aspect of the present invention provides the centrifugal separator based on the first aspect further comprising compensation means for compensating said rotational speeds at said first and second detections with a total of said measured time intervals from said first detection to said second detection.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

Figure 1:
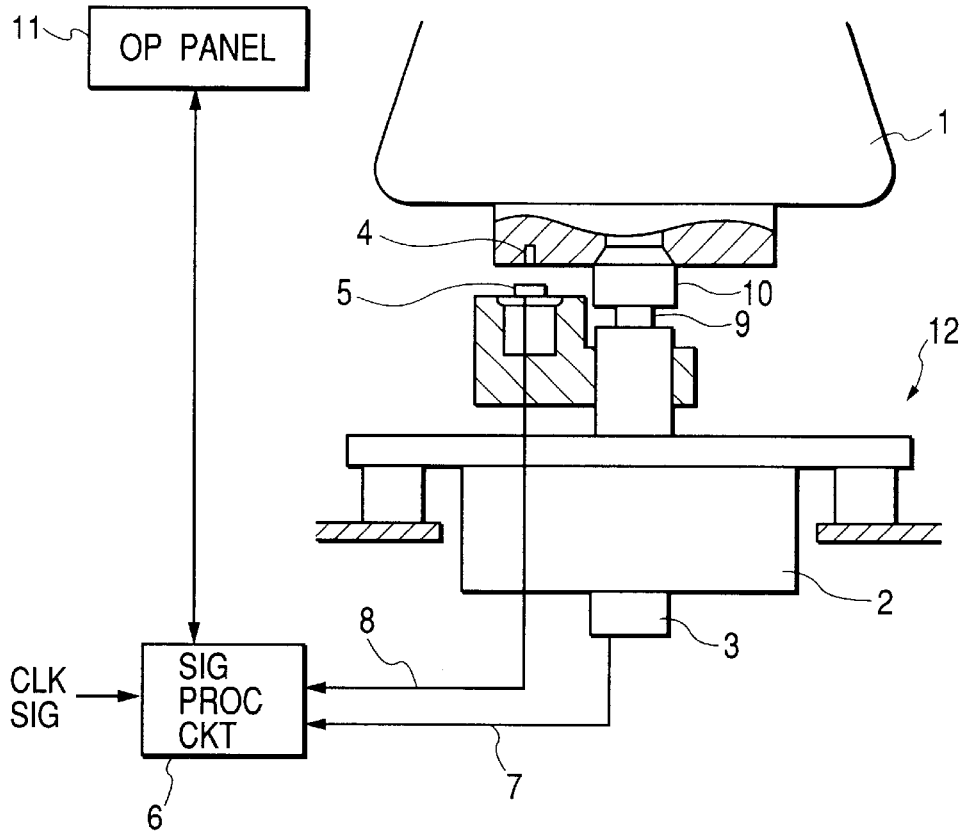
FIG. 1 is a block diagram of a centrifugal apparatus according to the present invention.
Figure 2:
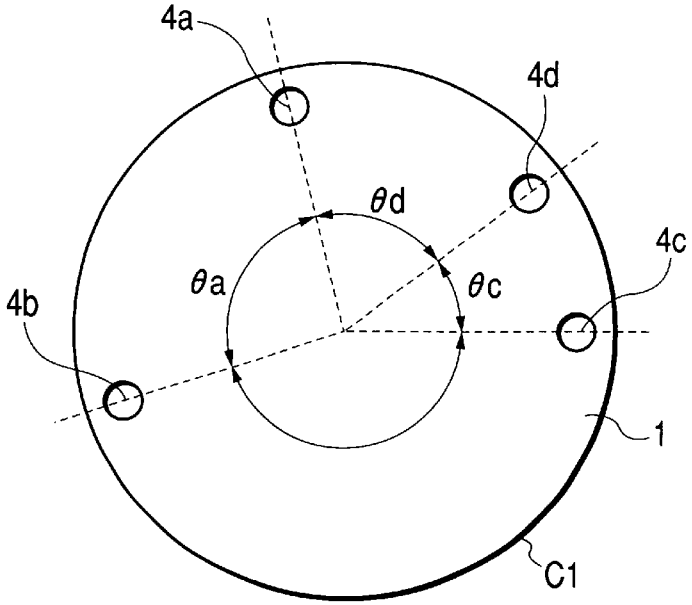
FIG. 2 shows a bottom view of a rotor shown in FIG. 1.
Figure 3A:
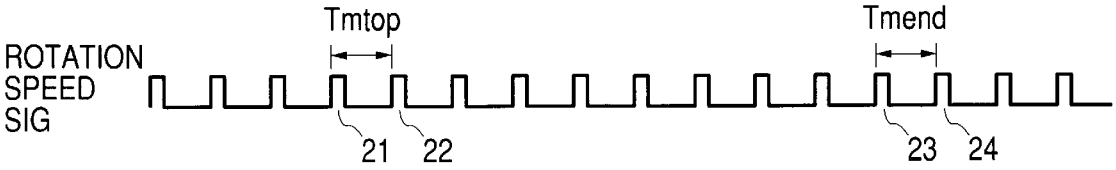
FIGS. 3A and 3B are time charts of a rotational speed signal and an identification mark signal detected in the centrifugal apparatus, respectively.
Figure 3B:
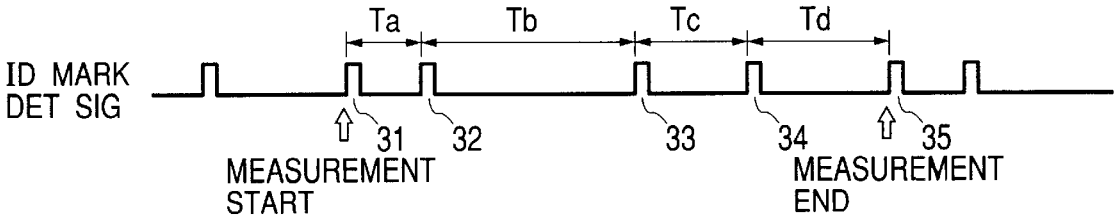
Figure 4:
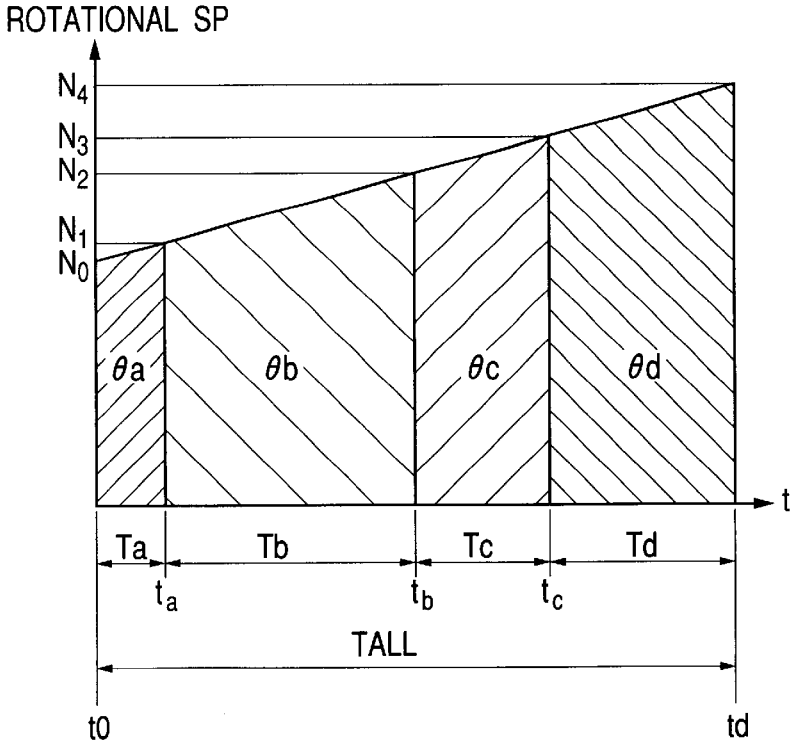
FIG. 4 is graphical drawing illustrating a calculation process of angular intervals of identification marks.

FIG. 1 is a block diagram of a centrifugal apparatus according to the present invention. FIG. 2 shows a bottom view of a replaceable rotor 1 shown in FIG. 1. FIGS. 3A and 3B are time charts of a rotational speed signal and an identification mark signal detected in the centrifugal apparatus, respectively. FIG. 4 is graphical drawing illustrating a calculation process of angular intervals of identification marks.

The centrifugal apparatus 1 includes an induction motor 2 forced-air-cooled by a fan (not shown) with an output axis 9 having an attaching unit 10 for attaching the rotor 1 to the output axis 9, an identification mark detector 5 for detecting a signal from an identification mark such as a magnetic fields from the magnets arranged on the bottom surface of the rotor 1 in accordance with rotation of the attached rotor 1, a rotational speed detector 3 for detecting the rotation of the motor 2 (output axis 9) to generate a rotational speed signal 7 to detect rotation of the output axis 9 to generate a predetermined number of pulses per the rotation of the output axis 9, and a signal processing circuit 6.

The centrifugal apparatus 1 further includes a rotor room (not shown) enclosing the rotor 1 rotatably. The inside of the rotor room is cooled by coolant flowing through a cooling pipe arranged around the rotor 1. The rotor room has a door (not shown) at the top thereof which is locked while rotating and unlocked while stopping to change the rotor 1. On the top of the rotor room, an operation panel 11 is arranged. The operation panel 11 is coupled to the signal processing circuit 6 to control the centrifugal apparatus 1 and to display the type of or the identification number of the attached rotor 1.

One of different rotors is attached to the output axis 9 with the attaching unit 10. The different (different types of) rotors have different patterns of the identification marks arranged on a circumference defined by said rotation axis on the bottom surface thereof with angular intervals which are predetermined for different rotors, as shown in FIG. 2. The identification marks 4*a* to 4*d* are arranged with arrangement angles θa between the identification marks 4*a* and 4*b*, θb between the identification marks 4*b* and 4*c*, θc between the identification marks 4*c* and 4*d*, and θd between the identification marks 4*d* and 4*a*. Theses angular intervals are used to discriminate each rotor or each type of rotors from others.

FIG. 3A shows the rotational speed signal 7 when the motor 2 rotates at a rotational speed, wherein pulses in the rotational speed are periodically generated. The rotational speed detector 3 generates nine rotation detection pulses per a rotation of the output axis 9.

FIG. 3B shows the identification mark detection signal 8 including pulses generated with intervals Ta, Tb, Tc, and Td corresponding to angular intervals θa, θb, θc, and θd, respectively.

Detection

The signal processing circuit 6 repeatedly measures time intervals between successive rotation detection pulses by counting clock pulses in a clock signal and as well as detects an identification mark detection pulse.

In this example, as shown in FIG. 3B, it is assumed that the measurement is started in response to the detection of the identification mark detection pulse 31 (identification mark 4*a*) during the time interval Tmtop. Thus, the signal processing circuit 6 obtains and stores the time interval Tmtop between successive rotation detection pulses 21 and 22 in response to the detection of the identification mark detection pulse 31 (measurement start) and the detection of rotation detection pulse 22.

Next, the signal processing circuit 6 detects the identification mark detection pulses 32 to 35, and detects timings t0, ta, tb, and tc of the identification mark detection pulses 31 to 35 and identification mark detection intervals Ta, Tb, Tc, and Td.

Moreover, the signal processing circuit 6 obtains the time interval Tmend during which the identification mark detection pulse 35 is detected, i.e., at fourth detection of the identification mark=one rotation, from the repeatedly detected time intervals between successive rotation detection pulses 23 and 24.

Calculation

The signal processing circuit 6 calculates the arrangement angles of the identification marks 4*a* to 4*d* as follows:

Because each of the time intervals Tmtop and Tmend is one of time intervals defined by nine rotation detection pulses per one rotation of the output axis 9 or the rotor 1, the rotational speed $N_0$ of the rotor 1 at the start of the measurement t0 and the rotational speed $N_4$ at the end of the measurement td are given by:

$$N_0 = \frac{9}{Tmtop},\ N_0 = \frac{9}{Tmend} \tag{1}$$

Here, if a sufficient accuracy in detection of the time intervals Tmtop and Tmend cannot be expected, the obtained rotational speeds $N_0$ and $N_4$ are compensated as follows:

Because the sum of the areas defined by the arrangement angles of θa, θb, θc, and θd corresponds to one rotation, and one rotation period Tall=Ta+Tb+Tc+Td, a compensation coefficient α is given by:

$$\frac{(\alpha N_0 + \alpha N_4) \times Tall}{2} = 1 \quad \therefore \alpha = \frac{2}{(N_0 + N_4) \times Tall} \tag{2}$$

Hereinafter, the rotational speeds $N_0$ and $N_4$ compensated with α will be used.

If the variation of the rotational speed is constant, the rotational speed proportionally increases with passage of time. Thus, the rotational speeds $N_1$, $N_2$, and $N_3$ at timings ta, tb, and tc (the identification detection pulses 32 and 33) are given by:

$$\begin{aligned} N_1 &= N_0 + \frac{Ta}{Tall}(N_4 - N_0), \\ N_2 &= N_0 + \frac{Ta + Tb}{Tall}(N_4 - N_0), \\ N_3 &= N_0 + \frac{Ta + Tb + Tc}{Tall}(N_4 - N_0) \end{aligned} \tag{3}$$

The arrangement angles of the identification marks are given by integrating the angular velocity (rotational speed). Then, the arrangement angles θa, θb, θc, and θd are obtained through the method of obtaining an area of a trapezoid as follows:

$$\begin{aligned} \theta a &= \frac{Ta \times (N_0 + N_1) \times 360^\circ}{2} \\ \theta b &= \frac{Tb \times (N_1 + N_2) \times 360^\circ}{2} \\ \theta c &= \frac{Tc \times (N_2 + N_3) \times 360^\circ}{2} \\ \theta d &= \frac{Td \times (N_3 + N_4) \times 360^\circ}{2} \end{aligned} \tag{4}$$

The signal processing circuit 6 judges or identifies the type or identification number of the attached rotor 1 from the calculated arrangement angles θa, θb, θc, and θd.

As mentioned above, in the centrifugal separator according to this invention, the rotating unit 12 comprises the induction motor 2 with the rotation axis 9. The rotor attaching unit 10 attaches one of different replaceable rotors 1 to the rotation axis 9. Each of the rotors 1 has a plurality of identification marks 4*a* to 4*d* arranged on the circumference (concentric circle) defined by the output axis 9 when the rotor 1 is attached on a surface thereof with angular intervals (pattern) which are predetermined for each of different rotors 1. The identification mark detector 5 detects the identification marks 4*a* to 4*d* in accordance with rotation of the attached rotor 1. The rotational speed detector 3 detects rotation of the output axis 9 to generate the rotational speed signal 7. The signal processing circuit 6 is responsive to the identification mark detector 5 and the rotational speed signal 7 and detects the angular intervals to identify the attached rotor 1. The signal processor 6 measures rotational speeds from the rotational speed signal 7 at first detection of one of the identification marks 4*a* and second detection of one of identification marks 4*d* after one rotation of the output axis 9 from the first detection, measures time intervals of the detected identification marks from the first detection to the second detection, calculates rotational speeds of the rotation axis 9 when others of the identification marks are detected from the measured time intervals and from the rotational speeds at the first and second detections, and integrates the measured and calculated rotational speeds with the measured time intervals to calculate the angular intervals, respectively, to identify the one of rotors attached to the rotating unit.

Moreover, the rotation detector 3 generates the rotational speed signal 7 with a predetermined number of pulses being generated per the rotation with a first resolution which is lower than a second resolution in the calculated angular interval.

More specifically, the rotational speed detector 3 only generates nine rotation detection pulses per rotation with variation in pulse width, so that the resolution of the rotational speed signal is not so high. On the other hand, the diameter of the concentric circle c1 arranging the identification marks 4*a* to 4*d* is larger than that of the rotational speed detector as show in FIGS. 1 and 2, so that the resolution of the identification mark detector 5 is higher than that of the rotational speed detector 3.

Moreover, the signal processing circuit 6 compensates the rotational speeds at the first and second detections with a total of the measured time intervals from the first detection to the second detection. This is also because the resolution of the identification mark detector 5 is higher than that of the rotational speed detector 3.

The arrangement angles θa, θb, θc, and θd obtained as mentioned above have a high accuracy because the measurement is free from affection of errors in the pulse widths of the rotation detection pulses. Moreover, this is because they are obtained through the linear approximation of the acceleration slope of the rotor 1.

The example mentioned above has been described with assumption that the rotor 1 is being accelerated. However, the arrangement angles can be detected in any condition, for example, at a constant rotational speed or in a deceleration condition. In the above-mentioned example, the measurement of the identification mark is started with detection of the identification mark 4*a*. However, the start of measurement can be started with detection of other identification marks 4*b* to 4*d*. In the above-mentioned example, the number of rotation detection pulses is nine. However, this invention is applicable to the case that the number of rotation detection pulses per rotation is more than one. Moreover, the rotational speed may be represented by a physical quantity signal such as a voltage signal. In this case, the rotational speed signal is immediately detected at timings t0 and td. Moreover, the above-mentioned example has been described with assumption that the number of the identification marks on the rotor 1 is four. However, this invention is applicable to the case that the number of the identification marks 4 is more than one. Moreover, the example has been described with assumption that the identification marks 4*a* to 4*d* are arranged on the bottom surface of the rotor 1. However, the identification marks 4*a* to 4*d* may be arranged on another concentric circle on the surface of the rotor 1. Moreover, the example has been described with assumption that the identification marks comprise magnets. However, other marks can be used as the identification marks. For example, optical reflection surfaces or protruding portions or hollow portions provides the identification marks. That is, any other identification detectors can be used if the detector can detect the used identification marks.

As mentioned above, the centrifugal apparatus according to this invention can detect arrangement angles of identification mark on the rotor without a long acceleration interval and without a high resolution rotation detector or a high accuracy rotation detector. This reduces the waiting interval of the user without increase in the cost of the rotational speed detector.

What is claimed is:

1. A centrifugal separator comprising:

a rotating unit having a rotation axis;

a rotor attaching means for attaching one of different replaceable rotors to said rotation axis, each of said rotors having a plurality of identification marks arranged on a circumference defined by said rotation axis on a surface thereof with angular intervals which are predetermined for each of said different rotors;

identification mark detection means for detecting said identification marks in accordance with rotation of said attached rotor;

a rotation detector for detecting rotation of said rotation axis to generate a rotational speed signal; and detection means responsive to said identification mark detection means and said rotational speed signal for detecting said angular intervals to identify said attached rotor, wherein said detection means measures rotating speeds from said rotational speed signal at first detection of one of said identification marks and second detection of said one of identification marks after one rotation of said rotation axis from said first detection, measures time intervals of said detected identification marks from said first detection to said second detection, calculates calculation rotational speeds of said rotation axis when others of said identification marks are detected from said measured time intervals and from said rotational speeds at said first and second detections, and integrates said measured rotational speeds and said calculation rotational speeds with said measured time intervals to calculate said angular intervals, respectively, to identify said one of rotors attached to said rotating unit.

2. The centrifugal separator as claimed in claim 1, wherein said rotation detector generates said rotational speed signal with a predetermined number of pulses being generated per said rotation with a first resolution which is lower than a second resolution in the calculated angular interval.

3. The centrifugal separator as claimed in claim 1, further comprising compensation means for compensating said rotational speeds at said first and second detections with a total of said measured time intervals from said first detection to said second detection.

* * * * *

UNITED STATES PATENT AND TRADEMARK OFFICE

CERTIFICATE OF CORRECTION

PATENT NO. : 6,616,588 B2
DATED : September 9, 2003
INVENTOR(S) : Hiroyuki Takahashi et al.

It is certified that error appears in the above-identified patent and that said Letters Patent is hereby corrected as shown below:

Title page,
Item [54], Title, reads "CENTRIFUGAL SEPARATOR WITH ROTOR IDENTIFICATION" should read -- CENTRIFUGAL SEPARATOR --

Signed and Sealed this

Sixth Day of July, 2004

JON W. DUDAS
*Acting Director of the United States Patent and Trademark Office*